United States Patent [19]

Dorosz

[11] Patent Number: 4,572,306

[45] **Date of Patent: * Feb. 25, 1986**

[54] JOURNAL BUSHING DRILL BIT CONSTRUCTION

[76] Inventor: Dennis D. E. Dorosz, 524 Culduthel Rd., Victoria, B.C., Canada, U8X 1G1

[ * ] Notice: The portion of the term of this patent subsequent to Oct. 23, 2001 has been disclaimed.

[21] Appl. No.: 679,547

[22] Filed: Dec. 7, 1984

[51] Int. Cl.[4] ..... E21B 10/22

[52] U.S. Cl. ..... 175/371; 384/94; 384/95

[58] Field of Search ..... 175/359, 369, 371, 372; 384/92-96

[56] References Cited

U.S. PATENT DOCUMENTS

| | | | |
|---|---|---|---|
| 3,620,580 | 11/1971 | Cunningham | 384/96 |
| 3,917,361 | 11/1975 | Murdoch | 384/92 |
| 4,157,122 | 6/1979 | Morris | 175/371 |
| 4,407,375 | 10/1983 | Nakamura | 384/93 |
| 4,478,299 | 10/1984 | Dorosz | 175/369 |

OTHER PUBLICATIONS

U.S. Defensive Publication No. T102,901, Offenbacher, "Method of Fabricating a Bearing", 4-5-83, FIG. 4.

*Primary Examiner*—Stephen J. Novosad
*Assistant Examiner*—John F. Letchford
*Attorney, Agent, or Firm*—Gunn, Lee & Jackson

[57] ABSTRACT

An earth boring drill bit having roller cutters which are rotatably supported on journals by bushings. At least one of the bushings is formed by a plurality of bushing segments which are positioned about a circular bearing surface having thrust shoulders at each end thereof. The roller cutter elements are assembled about the bushing segments in heated condition, by press-fitting to establish a firmly seated relationship between the cutter and bushing segments upon cooling of the cutter. The rotary cutter is then secured to the bushing segments by means of a locking element to prevent inadvertent disassembly during drilling operations. End portions of the bushing segments engage hardened bearing inserts of cutter support legs to minimize wear during drilling operations. A circular sealing element positioned about the bushing segments establishes sealing engagement with the cutter support legs to prevent ingress of contaminants and egress of lubricant during drilling activity.

14 Claims, 4 Drawing Figures

FIG.1
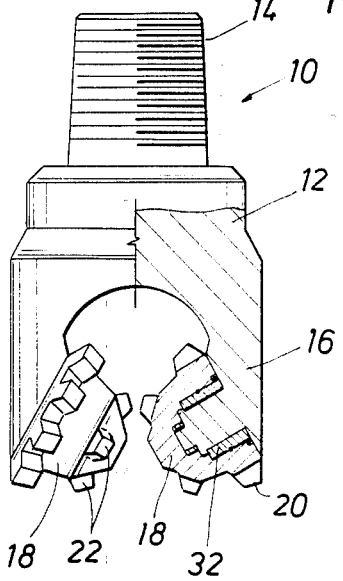
FIG. 2
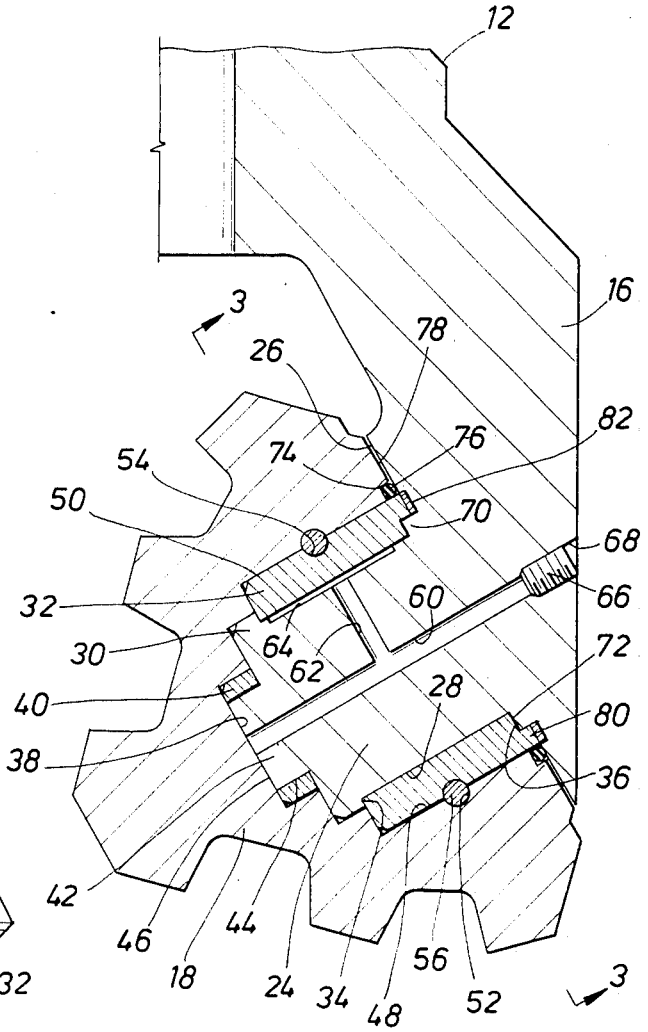
FIG. 3
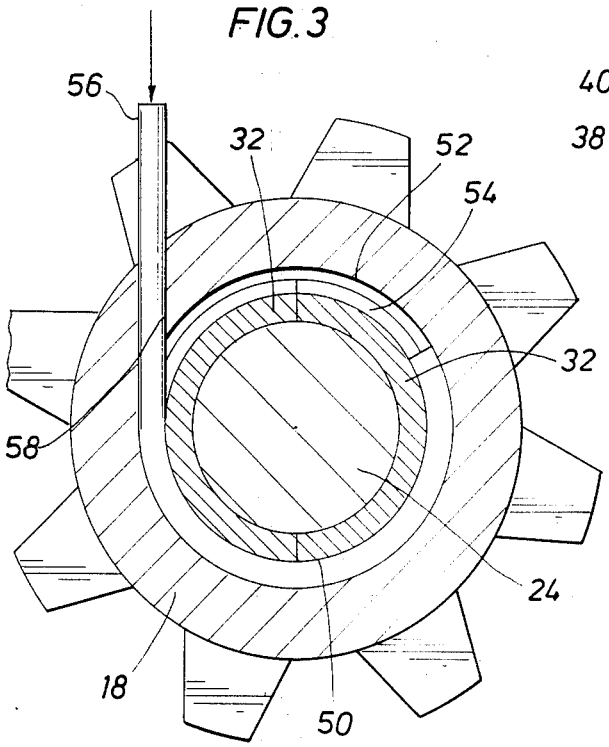
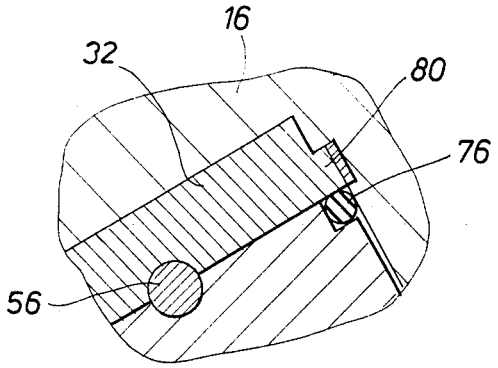
FIG. 4

JOURNAL BUSHING DRILL BIT CONSTRUCTION

FIELD OF THE INVENTION

This invention relates generally to earth boring drill bit apparatus and, more particularly, to rotary cone type rock bits having a plurality of rotary cutters for boring through relatively hard, consolidated earth formations such as during the drilling of deep wells for production of petroleum products. This invention also relates to a method of assembly the rotary cutter elements and bushings to cutter support journal elements of the drill bits.

BACKGROUND OF THE INVENTION

In the drilling of deep wells in earth formations, many different type of earth formations are encountered and boring or drilling operations in each of these types of formations require differing boring equipment. For example, in loose or unconsolidated earth formations such as gravel strata, it is desirable to utilize integral drill bits having a plurality of blades for cutting away the formation. Where consolidated, very hard earth strata is encountered, for example, in deep earth formations, it is typically desirable to employ drill bits having a plurality of rotary cone cutters having multiple projection cutter teeth. The teeth of the rotary cutters are cooperatively associated so that the earth formation is cut away as the drill bit is rotated at the extremity of a string of drill pipe extending from the drilling rig to the formation being drilled. The typical rotary cutter type drill bit or "rock bit" includes a body portion from which depend three legs. Spindles or cutter supports extend inwardly toward the center line of the drill bit from each of these legs. Rotary cone type cutter elements having cutter teeth formed thereon are typically rotatably secured to each of the supports or spindles and are oriented in such manner that the cutter teeth thereon engage and cut away the earth formation as the bit structure is rotated by the drill pipe.

One of the paramount disadvantages of drill bits having rotary cutters is the inability of the cutter bearings to withstand the severe wear inducing conditions to which the drill bit is typically subjected. As drilling operations occur, rock bits are subjected to severe impacting and vibration as well as other wear inducing factors that are highly detrimental to the service life of the rotary cutter bearings and other components of such drill bits. At times, much of the weight of the drill pipe to which the rotary drill is connected may be caused to act upon the cutter, subjecting the cutters and their bearings to tremendous mechanical loads. It is therefore desirable that rotary drill devices be provided which incorporate bushings having the capability of withstanding extremely high forces, excessive vibration as well as remaining serviceable during high temperature operation. Further, the extremely abrasive environment in which such drill bits operate cause the lubricant seals to wear at an accelerated rate. When this occurs, abrasive particles invade the seal interface, quickly inducing seal breakage due to seal wear. The bearings or bushings of the roller cones will then fail at an accelerated rate.

Typically, the drill bodies of rotary cutter devices take the form of integral cast or forged structures that are very expensive to manufacture because of the complex configuration thereof. It is also desirable to provide a rotary drill bit construction having a body structure of exceptional strength and durability and yet being of relatively low cost. Drill bit cost is also adversely affected by the typical requirement for expensive materials for most of the structural components of such bits. For example, an expensive bearing quality material may be required for the drill cutters of the entire body structure of the bit if any part thereof is to define a wear resistant bearing surface.

It is therefore a primary feature of the present invention to provide a novel rotary cone cutter type drill bit construction that allows optimum utilization of materials for the various components thereof to ensure optimum drilling capability and exceptional service life.

It is also a feature of the present invention to provide a novel rotary cone cutter type earth boring drill construction wherein a unique cutter supporting bushing and spindle assembly may be connected to structural components of the drill body by welding or may be formed integrally therewith, if deserved.

Among the several features of the present invention is contemplated the provision of a novel rotary earth boring drill construction incorporating bushing and spindle assemblies that, through optimum use of material, are capable of withstanding extremely severe operational loads.

It is an even further feature of the present invention to provide a novel rotary earth boring bit construction and novel method for assembly thereof which promote the low cost and exceptional reliability aspects of the drill construction.

It is also an important feature of the present invention to provide a novel rotary earth boring bit construction whereby rotary cutter elements are assembled to respective spindle and bearing assemblies utilizing controlled changes in dimension by heating various drill bit components and/or cooling interrelated bit parts to achieve optimum fit at normal temperature.

It is also a feature of the present invention to provide a novel rotary earth boring drill construction whereby mechanical locking means may be provided to ensure positive locking of rotary cutter elements to the spindle bearing and thereby ensure against separation of the cutter elements by vibration and other operationally induced forces.

It is a feature of the present invention to provide a method of manufacturing a rotary cutter type drill bit wherein cutter, and bushing/journal assemblies may be developed prior to attachment thereof to the drill body.

Other and further objects, advantages and features of the invention will become obvious to one skilled in the art upon an understanding of the illustrative embodiments about to be described and various advantages, not referred to herein, will occur to one skilled in the art upon employment of the invention to practice.

THE PRIOR ART

Rotary cone cutter type drill bits have been commercially available for an extended period of time as indicated by Godbold in U.S. Pat. No. 1,325,086. In some cases, the structure of the drill bit body has also been employed to accomplish bearing capability as taught by U.S. Pat. Nos. 2,620,686 of Peter and 3,361,494 of Galle. Various types of bearings have also been employed to support roller cone cutters, such as the complex structures illustrated in U.S. Pat. Nos. 1,839,589; 2,004,012; and 2,126,041, all of Reed. U.S. Pat. Nos. 1,839,589 and 2,004,012 of Reed and 1,957,532 of Flynn each disclose earth boring drill constructions employing spindle structures that are secured to the body structure of the bit by mechanical means such as welding, bolting or the like. More recently, U.S. Pat. No. 4,157,122 discloses retention of roller cone cutters by means of shrink fit bushings or split bushings.

SUMMARY OF THE INVENTION

Rotary cone earth boring drill bits are provided in accordance with the present invention, which employ rotary cutter elements that are uniquely connectable to the cutter support leg structures of the bit and which function efficiently to withstand the detrimental effects of excessive loads, vibration and heat encountered during well drilling operations. The body structure of the drill bit defines a plurality of cutter support legs each which form planar surfaces to which are juxtaposed the planar surfaces of rotary cone cutter elements supported by the legs. The respective cutter support legs of the drill bit body are each provided with journals in the form of stub axles, which journals may be formed integrally with the drill bit leg structures, or, in the alternative, may be assembled to the drill bit legs in any suitable manner. The journal elements project at proper angles from the cutter support legs to permit interrelated cutter activity. Typically, rock bits will incorporate three depending legs and three interrelated rotary cone cutter elements having cutter teeth that are cooperatively arranged to achieve efficient boring as the rock bit is rotated in relation to the earth formation being drilled. The body structure of the bit may be formed by a fabrication procedure wherein three interfitting body sections are connected by welding to form an integral body. Each of the body sections may be of forged construction, thereby permitting simplified manufacture of a drill bit body having exceptional strength and durability from the standpoint of metallurgy. These body sections are welded together to form an integral drill bit body structure having flow passages therein for conducting drilling fluid from drill stem to the area of contact between the rotary cutters and the formation being drilled.

In each case, the rotary cutter elements will be of generally cone-like configuration, having a plurality of external teeth formed thereon for cutting engagement with the earth formation being drilled. Each of the cutter elements is also formed to define an internal journal and bushing receptacle of a particular corresponding configuration to receive the assembled journal and bushings in close-fitting relation therein.

The journal elements of the drill bit structure define a generally cylindrical bearing surface with a bushing retainer enlargement located near at its free extremity to restrict axial movement of the segmented bushing positioned about the bearing surface. At the opposite extremity of the bearing surface, the journal forms another circuit thrust shoulder which restricts bushing movement in the opposite direction relative to the journal and forms a mechanical labyrinth to restrict leakage of lubricant. Because of the size of the bushing restraining enlargement, the bushing is defined by a plurality of bushing segments. Two bushing segments are shown but any suitable number may be employed within the scope of this invention.

The rotary cone cutter element is press-fitted about the bushing segments with its temperature at the time of assembly being elevated to establish a shrink-fitted, seized relationship between the cutter and bushing segments. Further, the cutter and bushing segments are interlocked in assembly by means of a circular locking element positioned within registering circular locking grooves in the cutter and bushing segments which cooperatively establish a circular locking receptacle therebetween. If desired, the journal and bushing segments may be cooled to assist in the shrink fit relationship.

Rotary cutter support is further enhanced by an inner bushing member of smaller diameter than the diameter of the bearing surface which is also press-fitted relative to the rotary cutter element and is journaled about a smaller, cylindrical bearing surface formed at the free extremity of the journal.

The rotary cone cutter and bushings are provided with lubrication by means of a lubrication system formed by lubricant passages extending through the journal and branching to conduct lubricant to the segmented bushing and to the smaller, inner bushing element. A lubricant seal in the form of an elastomeric O-ring or the like is positioned to engage the planar surface of the bit support leg and to also seal the outer periphery of the segmented bushing.

BRIEF DESCRIPTION OF THE DRAWINGS

In order that the manner in which the above-recited advantages and features of the invention are attained, as well as others which will become apparent, can be understood in detail, more particular description of the invention briefly summarized above may be had by reference to the specific embodiment thereof that is illustrated in the appended drawings, which drawings form a part of this specification. It is to be understood, however, that the appended drawings illustrate only a typical embodiment of this invention and are, therefore, not to be considered limiting of its scope, for the invention may admit to other equally effective embodiments.

IN THE DRAWINGS

FIG. 1 is a pictorial representation of a rotary rock bit constructed in accordance with the present invention and having three rotatable cutter cones in assembly therewith.

FIG. 2 is a transverse partial sectional view of the drill bit of FIG. 1, showing one of the cutter support legs and rotary cone cutter and bushing assemblies by way of cross section.

FIG. 3 is a sectional view taken along line 3—3 of FIG. 2.

FIG. 4 is an enlarged fragmentary sectional view showing portions of the cutter support leg, segmented bushing, lubricant seal and cutter element.

DETAILED DESCRIPTION OF PREFERRED EMBODIMENT

With reference now to the drawings and first to FIG. 1, a rotary cone cutter-type drill bit shown generally at 10 in quarter-section is of the type typically referred to in the industry as a "rock-bit." The rotary bit structure 10 generally comprises a body structure 12 having a threaded upper extremity 14 for attachment of the drill bit to the lower section of a string of drill pipe, not shown. The body structure 12 also includes a plurality of depending cutter support legs 16, each supporting a rotary cutter element such as shown at 18 and 20. Each of the cutter elements are provided with a plurality of teeth 22 formed thereon to provide for optimum engagement between the teeth of each of the cutter elements and the formation being drilled. Each of the cutter elements of the bit structure will be of slightly different configuration, whereby the teeth of each cutter will cooperate with the teeth of the other cutters to provide for efficient cutter engagement with the formation as the rock bit is rotated relative thereto.

Referring now to FIG. 2, each of the depending legs 16 of the body structure 12 is provided with a stub axle or journal 24 which extends in normal relation with a planar surface 26 defining an inner face of each of the depending legs. The stub axle or journal member 24 defines a cylindrical bearing surface 28 which is concentric with the axis of the journal. The cylindrical bearing surface 28 is of smaller diameter as compared to a journal enlargement 30, which functions as a restraining means to limit axial movement of segmented bushing means disposed in bearing engagement with the cylindrical surface 28. The bushing means 32 is, of necessity, in the form of a segmented bushing having two or more bushing segments enabling the bushing to be assembled about the journal. Opposite the circular restraining shoulder 34 defined by the enlargement 30 of the journal, the journal defines a second restraining shoulder 36 at its juncture with the leg 16. The second restraining shoulder 36 limits axial movement of the segmented bushing 32 in the opposite direction, toward the leg member 16. It also cooperates with the structure of the segmented bushing for a mechanical labyrinth retarding lubricant leakage. Each of the roller cones 18 is of particular construction, as mentioned above, to facilitate interrelated rock cutting activity. Particular configuration of the teeth of the roller cones 18 are not material to the concept of this invention. Rather, the manner by which the rotary cones are supported for rotational movement relative to the journal forms the foundation of this invention. The roller cone cutter member 18 defines an internal journal and bushing receptacle 38 of a particular internal configuration to receive the journal and bushings in close-fitting relation therein, the relationship of the inner bushing 40 to the roller cone being that of a press-fit or interference fit to thus maintain a nonrotatable relationship between the roller cone and the inner bushing. With the segmented bushing 32 in place on the cylindrical surface 28 of the journal and with the inner bushing 40 in assembly about the bearing surface 44 of end projection 42, the cutter cone 18 is heated to a temperature range of from about 300° F. to about 1000° F. and is then forced into assembly about the bushings. If desired, the journal and bushings may be cooled to reduce the dimension thereof. Following assembly the heated cutter cone will cool and shrink about the bushings thus positively seizing the bushings to develop a nonrotatable relationship that will not be loosened at elevated operating temperature. If cooled, the bushings will expand heating to achieve mechanical interlocking with the cutter cone member.

The journal 24 defines a bearing extension portion 42 forming an outer cylindrical surface 44 receiving the cylindrical inner surface of the bushing 40 in bearing relation therewith. The end surface 46 of the bearing extension is of circular, planar configuration and functions as a thrust stop engaging the inner planar surface of the bearing and bushing receptacle 38.

The outer surface portion of the journal and bushing receptacle is formed by an internal cylindrical surface 48 which perceives the outer cylindrical surfaces 50 of the bushing segments 32 in nonrotatable relation therewith. The relationship of engagement between cylindrical surfaces 48 and 50 is preferably that of an interference fit or press fit which ensures against relative rotation between these surfaces. Obviously, the bushing segments 32 are placed in assembly with the journal 24 about the reduced diameter cylindrical bearing surface 28, prior to assembly of the roller cone cutter member 18 about the segmented bushings 32.

To retain the roller cone cutter member in assembly with the segmented bushings, the inner wall structure of the cutter member 18 is machined to form a circular groove 52 of semicircular cross-sectional configuration. Likewise, the outer peripheral portions of the bearings segments 32 are machined to form a circular groove 54, also of semi-circular cross-sectional configuration. The grooves 52 and 54 are disposed in registry and cooperate to define a circular locking channel within which is received a locking ring 56. The locking ring is inserted after the roller cone cutter element has been brought into assembly with the segmented bushing 32. To facilitate installation of the locking ring, a lock insertion channel 58 is formed in the cutter element 18 as shown in FIG. 3, the channel 58 being disposed in substantially tangential relation to the circular locking groove. The lock element is defined by an elongated flexible metal member which is inserted through the insertion channel 58 and yields to a circular configuration as it is forced into the circular locking channel defined by registering grooves 52 and 54. The lock element is of circular cross-sectional configuration and is formed of any suitable, preferably dead, soft metal that is readily deformable to the circular configuration of the locking channel.

For lubrication of the bushing members 32 and 40, the leg portion 16 of the body structure 12 is drilled to form a lubricant supply passage 60 and a branch lubricant supply passage 62. The lubricant passage 60 terminates at the cylindrical surface 46 defined by the free extremity of the bearing extension 42. Lubricant material forced into the passage 60 is conducted between the opposed surfaces 38 and 46 to thus provide the inner bushing member 40 with lubricant at the bearing surface 44. The branch supply channel 62 terminates at an elongated supply slot or groove 64 which extends throughout a substantial portion of the link of the cylindrical bearing surface 28. Lubricant forced through passage 62 and supply channel or groove 64 therefore provides the bearing surface 28 and the opposed bushing surfaces with an ample supply of lubricant. The outer portion of the lubricant supply passage 60 is closed by means of a fitting 66 which is threadedly received within an enlarged outer opening 68. The fitting 66 may take the form of a lubricant injection fitting or simply a closure for the outer portion of the lubricant supply passage. The passages 60, 62 and the lubricant supply slot 64 function as reservoirs for sufficient lubricant material to achieve lubrication over an extended period of service life. If the fitting 66 is a lubricant injection fitting, each time the drill bit is brought to the surface, additional lubricant may be injected into the passage 60 by any suitable means.

To minimize the loss of lubricant material from the journal and bushing assembly, the journal defines a circular shoulder 70 at its juncture with the leg member 16. Consequently, the bushing segments 32 are formed to define an internal circular groove 72 for corresponding relation therewith. The circular shoulder 70 and groove 72 fit in such manner as to define a circular labyrinth which offers mechanical resistance to loss of lubricant. Further, radially outwardly of the cylindrical internal surface 48 of the roller cone member 18, the roller cone is formed to define a circular seal groove 74 of rectangular cross-sectional configuration, the inner surface portion of the seal groove being defined by the outer peripheral portion of the segmented bushing 32. Within the seal groove is positioned a resilient O-ring type sealing member 76 establishing sealing engagement with the outer peripheral surfaces of the bushing segments 32 and the roller cone cutter element. The sealing element 76 also establishing engagement with the planar surface 26 immediately surrounding the segmented bushing 32. The sealing capability of the sealing element 76 establishes an efficient lubricant seal preventing leakage of lubricant from the bushing assembly and lubricant reservoir during operation of the drilling bit. Due to the relatively narrow spacing of the planar surface 26 and a circular planar surface 78 defined by the roller cone cutter element contaminant access to the sealing member 76 is fairly restricted. Thus, the wear life of the seal member 76 is exceptionally good and thus the rock bit 10 will have extended service life as compared to other types of rock bits.

The segmented bushing element 32 forms an outer peripheral extension 80 which projects axially beyond the planar surface 78 of the cutter element 18. Thus, as thrust forces are applied to the cutter element during rotation thereof, such thrust forces are transmitted by the segmenting bushing 32 to the planar surface 26 of the arm 16. Thus, the spacing between planar surfaces 26 and 78 is not closed and the resilient sealing member 76 is not subjected to overcompression. To prevent excessive wear of the journal face 26 by the bushing extension 80, tungsten carbide inserts 82 or hard facing material of any other suitable character may be positioned immediately about the circular shoulder 70 of the journal 24.

The bushing and journal bearing surfaces of a journal bushing three cone rock bit may be afforded protection from external contamination such as drill cuttings, dust, debris, drilling fluid, etc., while securing the retention of bearing lubricants within the lubricant reservoir of the cones by means of an elastomeric sealing member located at the base of the journal spindle. The elastomeric seal is located in a seal cavity machined into the bushing and the journal. The seal cavity is machined such that minimal compressive forces are acting upon the seal. The elastomeric seal is seated in the seal cavity creating a friction fit between the bushing, seal and journal by the compressive forces resulting from the shrink fit of the cutter cone onto the bushings mounted on the spindle. To optimize the effectiveness of the elastomeric seal and to create a second seal, the invention incorporates a bushing whose length is longer than the bushing cavity in the cutter cone by a suitable length, such as 0.005 inch, for example, thereby resulting in the cutter cone assembly rotating on the base of the bushing and the journal face. As drilling forces are applied to the cutter cone, the bushing seats on the journal face and creates a mechanical seal. As the bushing seats into the journal face, the elastomeric seal is compressed into the seal cavity resulting in optimal compression and friction coefficients for the elastomer. To prevent excessive wear of the journal face by the bushing, tungsten carbide inserts are inserted into the journal face around the spindle in key pressure and wearing locations. These tungsten carbide inserts are recessed into the journal face by any suitable depth, such as 0.005 inch, for example, to allow the bushing to wear and seat into the journal face thereby creating a mechanical seal while preventing excessive wear and penetration into the journal face which would normally result in damage to the elastomeric seal and abnormal cocking of the cutter cone on the spindle, resulting in wear to the bearing surfaces of the spindle.

From the foregoing, it is evident that I have provided a novel rotary cone type drilling bit having a lubricated journal bushing system that minimizes seal wear and lubrication effectiveness during the life of the drilling bit. These features promote efficient extended life serviceability. It is clearly evident, therefore, that the present invention is one well adapted to attain all of the objects and advantages hereinabove set forth, together with other objects and advantages that are inherent from a description of the apparatus itself.

It will be understood that certain combinations and subcombinations are of utility and may be employed without reference to other features and subcombinations. This is contemplated by and is within the scope of the present invention.

As many possible embodiments may be made of this invention without departing from the spirit and scope thereof. It is to be understood that all matters hereinabove set forth or shown in the accompanying drawings are to be interpreted as illustrative and not in any limiting sense.

What is claimed is:

1. A rotary earth boring bit, comprising:

(a) a body structure adapted for threaded connection to a string of drill stem, said body structure defining a plurality of cutter support legs, each forming planar surface means;

(b) journal means extending transversely from each of said cutter support legs and being oriented in normal relation with said planar surface means, said journal means defining bushing retainer means and reduced diameter bearing surface means of smaller dimension than said bushing retainer means;

(c) rotary cone cutter means defining external cutter teeth and forming an internal journal and bushing receptacle, said rotary cutter means forming planar cutter surface means;

(d) segmented bushing means being positioned about said bearing surface means and being received in mechanically seized relation within said journal and bushing receptacle, end portions of said segmented bushing means extending beyond said planar cutter surface means for engagement with said planar surface means of said cutter support legs and maintaining said planar cutter surface means in spaced relation with said planar surface means of said cutter support legs, said segmented bushing means and said rotary cone cutter means cooperatively forming a circular seal recess intersecting said planar cutter surface means;

(e) locking means being positioned about said segmented bushing means within said journal and bushing receptacle and securing said rotary cutter means in locked assembly with said segmented bushing means, whereby said rotary cutter means and said segmented bushing means are rotatably mounted on said journal means; and (f) circular seal means disposed within said circular seal recess and being positioned about said segmented bushing means and establishing a seal with said planar surface means of said cutter support legs and with said segmented bushing means.

2. A rotary earth boring drill bit as recited in claim 1, wherein:

(a) said cutter support legs define bearing insert receptacle means about said journal means; and (b) hardened circular bearing means is positioned within said bearing receptacle means of said cutter support legs and forms at least a portion of said planar surface means of said cutter support legs; and (c) said end portions of said segmented bushing means establish bearing engagement with said hardened bearing inserts.

3. A rotary earth boring drill bit as recited in claim 1, wherein:

(a) said segmented bushing means and said rotary cone cutter means each define registering circular locking grooves of semicircular cross-sectional configuration;

(b) said rotary cone cutter means defines lock insert passage means intersecting said circular locking groove of said rotary cutter means; and (c) said locking means comprises an elongated yieldable locking member capable of being inserted through said lock insert opening into the locking groove defined by said registering locking grooves.

4. A rotary earth boring drill bit as recited in claim 1, wherein:

(a) said journal means defines a planar surface at the free extremity thereof; and (b) said rotary cutter means forms a planar surface defining the inner extremity of said journal and bushing receptacle, said planar surface of said rotary cutter means engaging said planar surface of said journal means to thus cooperatively limit relative axial movement of said rotary ncutter means to said journal means.

5. A rotary earth boring drill bit as recited in claim 1, wherein:

each of said cutter support legs forms lubricant passage means intersecting said bearing surface means to thus provide a supply of lubricant between said bearing surface means and said segmented bushing means.

6. A rotary earth boring drill bit as recited in claim 5, wherein:

said lubricant passage means includes elongated lubricant slot means formed in said journal means and extending along a major portion of said bearing surface means to thus provide for supply of lubricant along a major portion of the length of said bearing surface means.

7. A rotary earth boring drill bit as recited in claim 1, wherein:

said rotary cone cutter means is assembled about said segmented bushing means and journal means in heated condition whereby upon cooling of said rotary cutter means to the temperature of said segmented bushing means and journal means, said rotary cutter means becomes seized in immovable relation relative to said segmented bushing means.

8. A rotary earth boring drill bit as recited in claim 7, wherein:

said rotary cutter means is press-fitted about said segmented bushing means with said segmented bushing means assembled to said journal means while said rotary cutter means is heated to a temperature range of from about 300° F. to about 1000° F.

9. A rotary earth boring drill bit as recited in claim 1, wherein:

(a) said journal means forms second bearing surface means of smaller dimension than said bearing surface means and being located on the opposite side of said bearing retainer means from said bearing surface means; and (b) second bushing means is disposed in bearing relation with said second bearing surface means and is disposed in mechanically seized relation with said rotary cone cutter means.

10. A rotary earth boring drill bit as recited in claim 9, including:

(a) lubricant supply passage means extending through said journal means and having branch passages supplying lubricant respectively to said segmented bushing means and said second bushing means.

11. A rotary earth boring drill bit as recited in claim 9, wherein:

said bearing surface means and said second bearing surfaces means are of generally cylindrical configuration and are disposed in concentric relation with one another and with said journal means.

12. A rotary earth boring drill bit as recited in claim 1, wherein:

said bushing retainer means comprises an enlargement formed on said journal means, said enlargement forming a circular thrust support surface positioned for engagement by the inner extremities of said segmented bushing means.

13. A rotary earth boring drill bit as recited in claim 12, wherein:

(a) said journal means forms second thrust shoulder means positioned in spaced relation with said thrust shoulder means and located adjacent the respective one of said cutter support legs; and (b) said segmented bushing means each define circular thrust surface means for engagement with said thrust shoulder means and said second thrust shoulder means to thereby limit axial movement of said segmented bushing means relative to said journal means.

14. A rotary earth boring drill bit as recited in claim 12, wherein:

said thrust shoulder means and said second thrust shoulder means are located at opposite extremities of said bearing surface means of said journal means.

* * * * *